US006807951B2

(12) United States Patent
Fehlmann et al.

(10) Patent No.: US 6,807,951 B2
(45) Date of Patent: Oct. 26, 2004

(54) HIGH-PRESSURE FUEL PUMP WITH INTEGRATED BLOCKING-VANE PREFEED PUMP

(75) Inventors: Wolfgang Fehlmann, Stuttgart (DE); Juergen Frasch, Holzgerlingen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/315,122

(22) Filed: Dec. 10, 2002

(65) Prior Publication Data

US 2004/0105761 A1 Jun. 3, 2004

(30) Foreign Application Priority Data

Dec. 13, 2001 (DE) ..... 101 61 258

(51) Int. Cl.[7] ..... F02M 37/04
(52) U.S. Cl. ..... 123/508; 123/495
(58) Field of Search ..... 123/505, 495, 123/510, 511; 417/244, 245, 252

(56) References Cited

U.S. PATENT DOCUMENTS 4,567,872 A * 2/1986 Roosa ..... 123/470
5,549,452 A 8/1996 Vogt
6,263,843 B1 * 7/2001 Todo et al. ..... 123/90.17

FOREIGN PATENT DOCUMENTS

DE 41 03 986 A1 8/1991
DE 197 36 160 A1 2/1999
FR 2 429 463 1/1980

* cited by examiner

*Primary Examiner*—Mahmoud Gimie
(74) *Attorney, Agent, or Firm*—Ronald E. Greigg

(57) ABSTRACT

A high-pressure fuel pump having at least one pump element is driven by a camshaft. An inside chamber of the pump housing, together with the cam-shaped portion of the camshaft and a blocking vane, forms a blocking-vane pump, which can act as a prefeed pump for the at least one pump element, whereby a prefeed pump can be integrated with the high-pressure fuel pump, which saves both production costs and installation space.

19 Claims, 4 Drawing Sheets

HIGH-PRESSURE FUEL PUMP WITH INTEGRATED BLOCKING-VANE PREFEED PUMP

BACKGROUND OF THE INVENTION

1. Field of the Invention

The invention relates to a high-pressure fuel pump for an injection system of an internal combustion engine, having a pump housing, having at least one pump element, and having a camshaft for driving the pump element.

2. Description of the Prior Art

One high-pressure fuel pump of the type with which this invention is concerned, known for instance from European Patent Disclosure EP 0 481 964 B2, requires a prefeed pump, which pumps fuel from a fuel tank to the pump element of the high-pressure fuel pump.

OBJECTS AND SUMMARY OF THE INVENTION

The object of the present invention is to furnish a high-pressure fuel pump with an integrated prefeed pump that is constructed simply and can be produced economically. In a high-pressure fuel pump for an injection system of an internal combustion engine, having a pump housing, having at least one pump element, and having a camshaft for driving the pump element, this object is attained in that the pump housing, the camshaft, and a blocking vane cooperating with the camshaft form a blocking-vane pump, and that the blocking-vane pump pumps fuel to the at least one pump element.

By means of this prefeed pump integrated with the high-pressure fuel pump, an otherwise required electrical prefeed pump can be dispensed with entirely or at least for the most part. By the use of components that are present anyway, such as the pump housing and the camshaft, the costs for the blocking-vane pump of the invention are quite low. Moreover, the number of components required is increased only by one blocking vane, so that assembly is not made significantly more expensive, either. Finally, it should be noted that the blocking-vane pump of the invention requires no additional installation space, space that is available to only a very limited extent in modern internal combustion engines and modern vehicles.

In a variant of the invention, it is provided that an inside chamber is recessed out of the pump housing; that the camshaft rotates in the inside chamber; and that the blocking vane and the camshaft divide the inside chamber into a suction chamber and a pressure chamber, so that a blocking-vane pump can be realized at the least possible engineering effort or expense.

In a supplement to the invention, it is provided that a first hydraulic connection exists between the pressure chamber and the pump element, through which the blocking-vane pump pumps fuel to the pump element.

In an especially simple embodiment of the blocking-vane pump of the invention, a groove is provided on the side of the blocking vane toward the pressure chamber, which groove is part of the first hydraulic connection. As a result, the first hydraulic connection can be realized at the least possible effort or expense.

In a further feature of the invention, the pressure chamber is located opposite the pump element, so that at least a partial radial force compensation is created for the camshaft, and moreover the volume of the suction chamber is independent of the position of the piston of the pump element.

It has proved advantageous if a roller tappet is disposed between the pump element and the camshaft, since in this way major forces can be transmitted from the camshaft to the pump element.

Alternative features of the invention provide that the roller tappet is guided in the pump housing; and that a second hydraulic connection is provided between the side of the roller tappet remote from the inside chamber and the suction chamber, so that a pressure equalization is possible. The side of the roller tappet remote from the inside chamber can also be subjected to the pressure of the first hydraulic connection, so that the roller tappet is pressed by the hydraulic force acting on it against the camshaft. In this exemplary embodiment, a spring between the pump housing and the roller tappet can be dispensed with.

To enable better adaptation of the pressing force of the roller tappet on the camshaft, a throttle can be provided in the second hydraulic connection.

The pumping quantity regulation in the high-pressure fuel pump of the invention can be effected by means of an intake throttle regulator or by diverting the excess pumping quantity during the pumping stroke of the at least one pump element, so that the most favorable pumping quantity regulation for a given application can be employed in each case.

Other features of the invention provide that the camshaft has a plurality of cams distributed over its circumference, and/or is embodied integrally with a shaft of the engine, in particular with a compensation shaft or a camshaft, and/or that the high-pressure fuel pump is flanged to the engine, so that the pumping quantity of the high-pressure fuel pump of the invention can be varied within limits by means of the design of the camshaft, and the engineering effort and expense and the installation space required can both be reduced still further.

The high-pressure fuel pump of the invention can be used in particular in a fuel injection system with a high-pressure fuel reservoir (common rail).

BRIEF DESCRIPTION OF THE DRAWINGS

Further advantages and advantageous features of the invention will become apparent from the detailed description contained herein below, taken in conjunction with the drawings, in which.

DESCRIPTION OF THE PREFERRED EMBODIMENTS

Figure 1A:
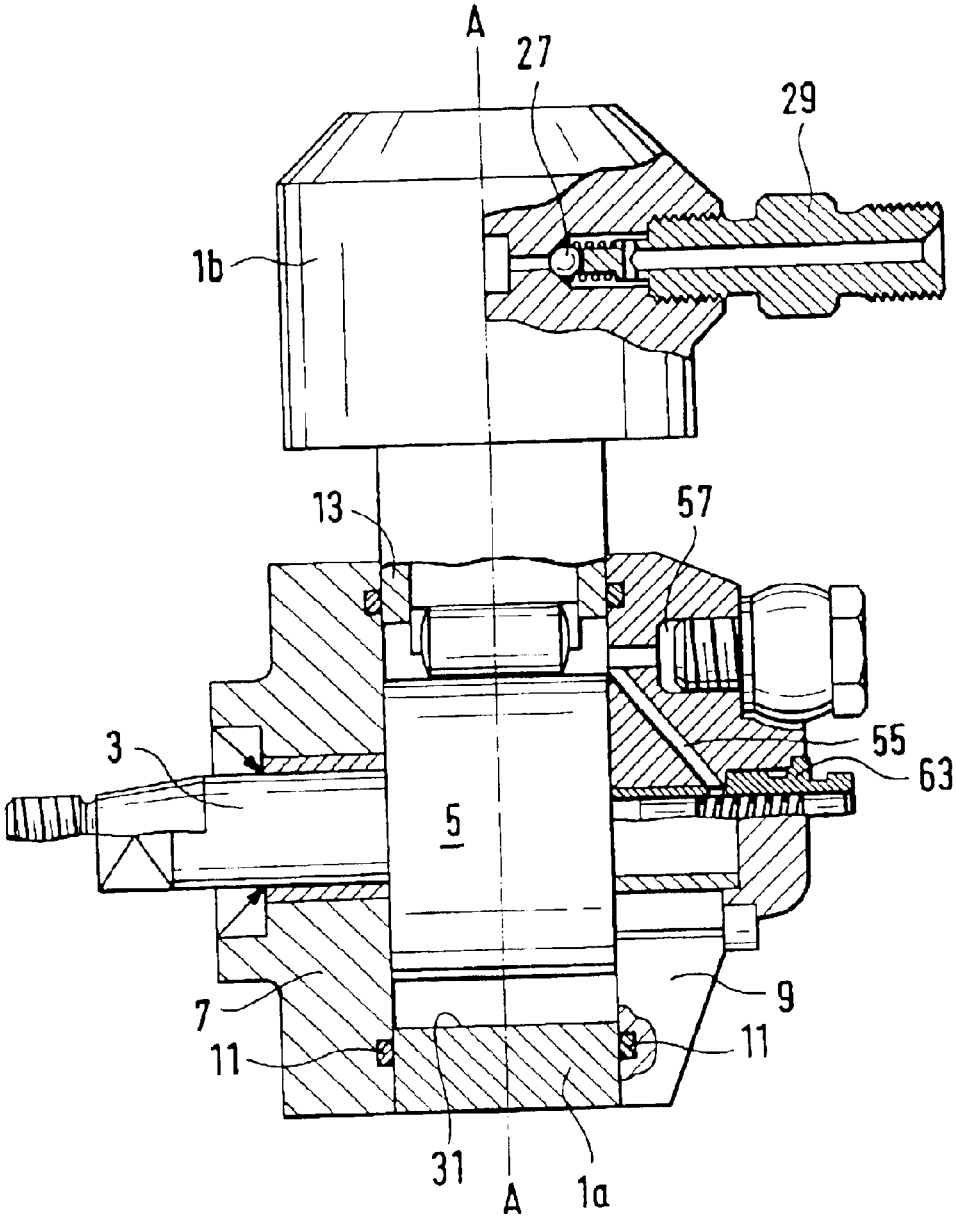
FIG. 1*a* is a fragmentary sectional view of a first exemplary embodiment of a high-pressure fuel pump of the invention.
Figure 1B:
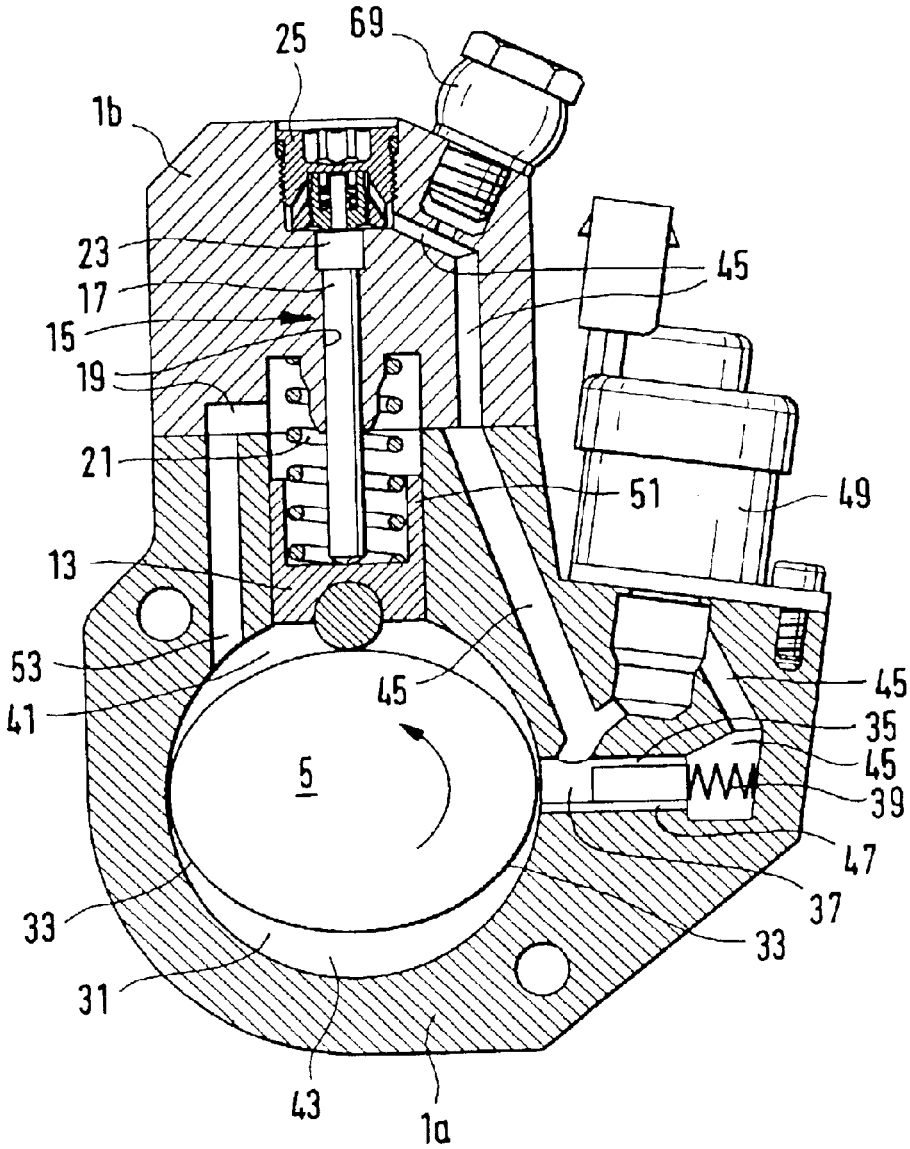
FIG. 1*b* is a vertical sectional view of the pump shown in FIG. 1*a;*

The first exemplary embodiment of a high-pressure fuel pump of the invention, shown in longitudinal section in FIG. 1*a* and in cross section in FIG. 1*b* along the section line A—A, comprises a pump housing 1*a* and 1*b*, and a camshaft 3. The camshaft 3 is supported rotatably, to the right and left of a camlike portion 5 of the camshaft 3, in a first bearing cap 7 and a second bearing cap 9. In the embodiment shown in FIG. 1*a*, the first bearing cap 7 and the second bearing cap 9 are associated with the housing 1*a*. In alternative embodiments, not shown, the first bearing cap 7 can for instance be part of a cylinder head of an internal combustion engine, and the camshaft 3 can be embodied integrally with the camshaft of the engine. Seals 11 are provided between the pump housing 1*a* and both the first bearing cap 7 and the second bearing cap 9. The camlike portion 5 of the camshaft 3, via a roller tappet 13, actuates a pump element 15, which can clearly be seen in the cross-sectional view of FIG. 1*b*.

FIG. 1*b* also shows that the pump housing is embodied in two parts, 1*a* and 1*b*. The pump element 15 essentially comprises a pump piston 17, which is guided sealingly in a cylinder bore 19. By the rotation of the camshaft 3, which is represented in FIG. 1*b* by an arrow, the pump piston 17 is made to execute an oscillating motion via the roller tappet 13. A compression spring 21 fastened between the pump housing 1*b* and the roller tappet 13 serves to keep the roller tappet 13 in contact with the camlike portion 5 of the camshaft 3. By way of means not shown in detail in FIG. 1*b*, such as a snap ring, spring washer, or the like, the pump piston 17 is coupled with the roller tappet 13, so that the pump piston 17 executes an oscillating motion as soon as the camshaft 3 is rotated. As a result of the oscillating motion of the pump piston 17, the volume of a pumping chamber 23 periodically changes. When the pump piston 17 moves downward in FIG. 1*b*, the volume of the pumping chamber 23 increases, and fuel is aspirated into the pumping chamber 23 via a suction valve 25. As the piston moves from its bottom dead center in the direction of its top dead center, the volume of the pumping chamber 23 decreases, and the fuel (not shown) located in the chamber is put under pressure by the pump piston 17. As soon as the outlet valve 27 (shown in FIG. 1*a*) opens, the pump piston 17 forces the fuel out of the pumping chamber 23 into a high-pressure connection 29. The high-pressure connection 29 leads to a high-pressure fuel reservoir (common rail), not shown.

An inside chamber 31 of cylindrical geometry is recessed out of the pump housing 1*a*. The diameter of chamber 31 is equal to the tip circle of the camlike portion 5 of the camshaft 3, so that virtually no gap remains between the cam 33 of the camlike portion 5 and the inside chamber 31. A recess 35 is provided in the pump housing 1*a*, and a blocking vane 37 is disposed displaceably in it. The blocking vane 37 is pressed against the camlike portion 5 by a second compression spring 39. The cam 33 and the blocking vane 37 divide the inside chamber 31 into a suction chamber 41 and pressure chamber 43. Between the pressure chamber 43 and the inlet valve 25 of the pump element 15, there is a first hydraulic connection 45. The connection 45 comprises many interconnected bores and a groove 47 in the blocking vane 37, which groove is disposed on the side of the blocking vane toward the pressure chamber 43. A metering device 49 is also disposed in the first hydraulic connection. Accordingly, the exemplary embodiment of FIGS. 1*a* and 1*b* is equipped with an intake throttle regulator. However, the invention is not limited to high-pressure fuel pumps with this kind of regulator.

Between the side 51 of roller tappet 13 remote from the suction chamber 41 and the suction chamber 41, there is a second hydraulic connection 53, which makes the free motion of the roller tappet 13 in the pump housing possible.

When the camshaft 3 is driven, the pump element 15 and the blocking-vane pump, formed of the inside chamber 31, the camlike portion 5, and the blocking vane 37, are driven simultaneously. The blocking-vane pump always pumps enough fuel into the first hydraulic connection 45 that there is adequate fuel available for the pump element 15 under all operating conditions. It is understood that a plurality of pump elements 15 can also be supplied by such a blocking-vane pump. As long as the pressure in the first hydraulic connection 45 has not yet built up, the second compression spring 39 must press the blocking vane 37 against the camlike portion 5. As soon as the pressure has built up in the first hydraulic portion 45, the blocking vane 37 is additionally pressed by this pressure against the camlike portion 5, which improves the sealing between the suction chamber 41 and the pressure chamber 43.

The excess fuel pumped by the blocking-vane pump is returned to the suction chamber 41 via a pressure regulating valve 63 and a bore 55, which is visible in FIG. 1*a*. Also discharging into the bore 55 is a fuel inlet 57, from which fuel from a fuel tank, not shown, reaches the high-pressure fuel pump. In certain applications, an electrical prefeed pump (also not shown) is also integrated between the fuel tank, not shown, and the fuel inlet 57.

Figure 2A:
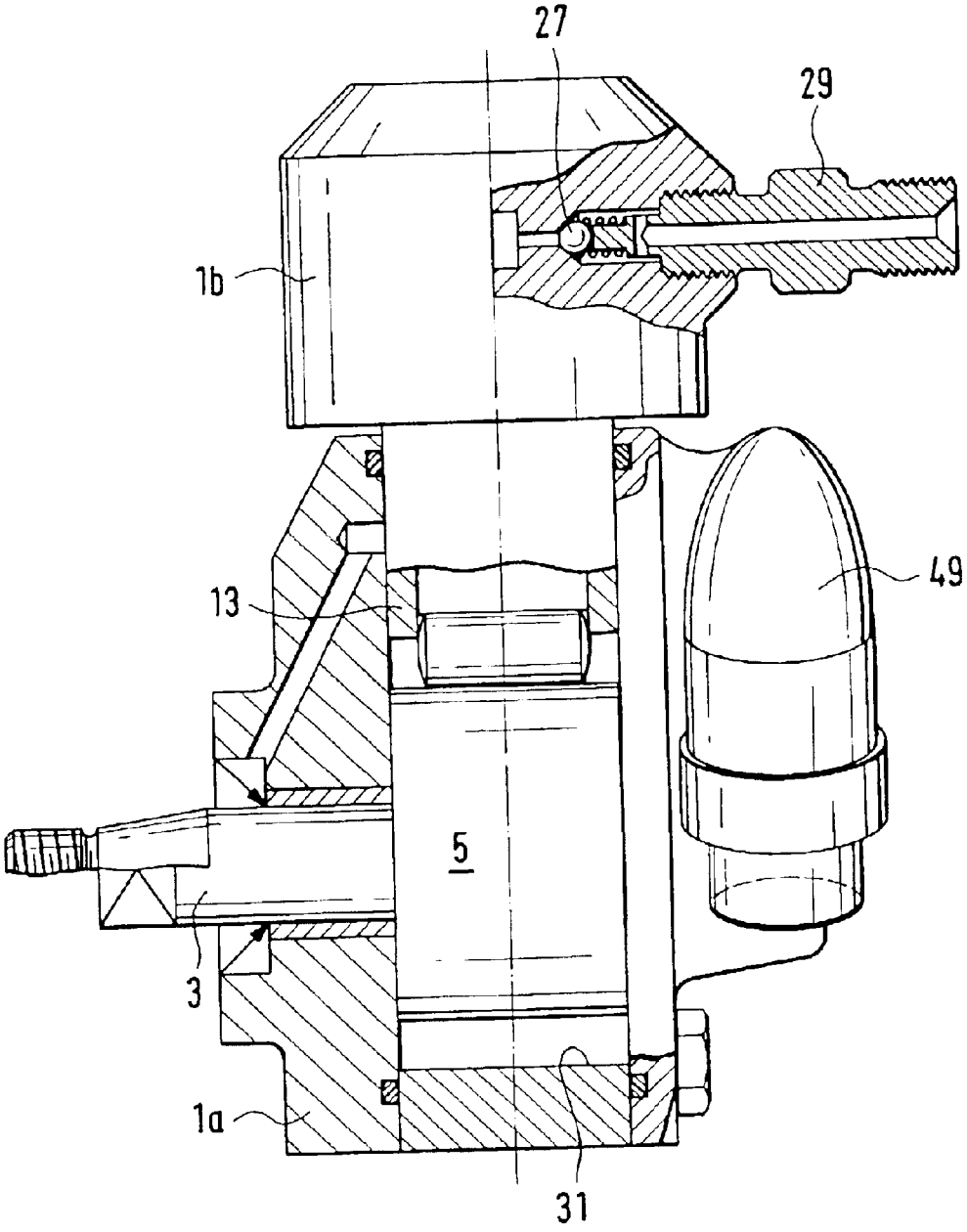
FIG. 2*a* is a view similar to FIG. 1*a* of a second exemplary embodiment of a high-pressure fuel pump of the invention.
Figure 2B:
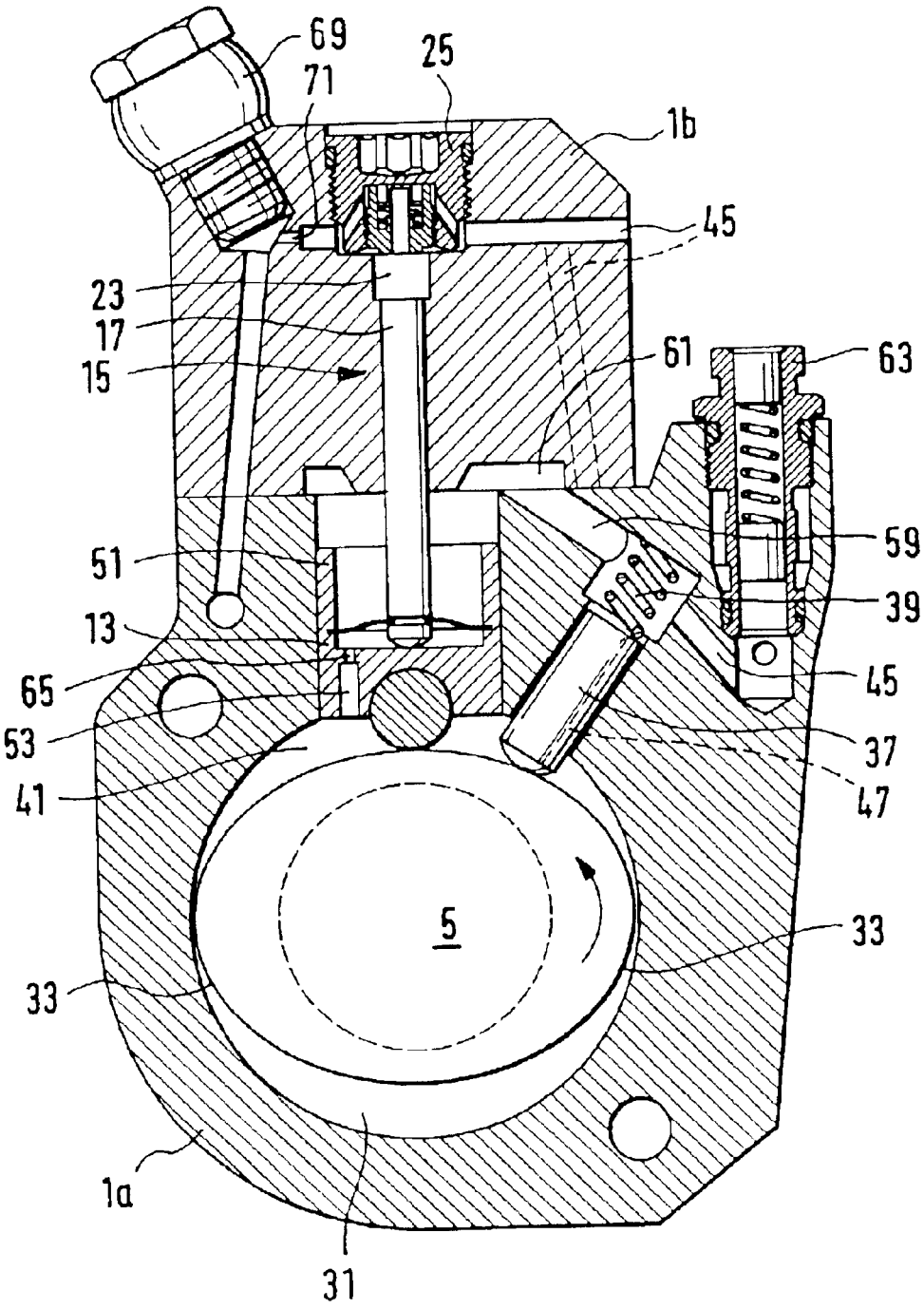
FIG. 2*b* is a vertical sectional view of the pump shown in FIG. 2*b*.

In FIGS. 2*a* and 2*b*, a second exemplary embodiment of the high-pressure fuel pump of the invention is shown. Identical components are identified by the same reference numerals, and what has been said with regard to FIGS. 1*a* and 1*b* applies accordingly. In this exemplary embodiment, the requisite pressure force of the roller tappet 13 on the camlike portion 5 is brought to bear hydraulically. To that end, some of the fuel pumped by the blocking-vane pump into the first hydraulic connection 45 is pumped through a connecting bore 59 and an annular groove 61 to the side 51, remote from the suction chamber, of the roller tappet 13. A pressure regulating valve 63 assures that the pressure force of the roller tappet 13 on the camlike portion 5 remains within predetermined limits. A throttle 65 is provided in the second hydraulic connection 53. The piston 17 is coupled with the roller tappet 13 via a spring washer 67. It is understood that other kinds of couplings may also be made between the piston 17 and the roller tappet 13. What is important is that the force required to aspirate fuel into the pumping chamber 23 be capable of being transmitted from the roller tappet 13 to the piston 17. Also, it must be possible for the requisite force to be transmitted from the roller tappet 13 to the piston 17 during the pumping stroke. Via a fuel return 69, excess fuel that does not reach the pumping chamber 23 can be returned to the fuel tank, not shown. In this exemplary embodiment, between the suction valve 25 and the fuel return 69, a zero-feed throttle 71 is provided, which assures that in the overrunning mode of the engine, no pressure will build up in the first hydraulic connection 45, despite the closed metering device 49.

The foregoing relates to preferred exemplary embodiments of the invention, it being understood that other variants and embodiments thereof are possible within the spirit and scope of the invention, the latter being defined by the appended claims.

What is claimed is:

1. A high-pressure fuel pump for an injection system of an internal combustion engine, comprising a pump housing, at least one pump element (15), a camshaft (3) for driving the pump element (15), and a blocking vane (37), the pump housing (1), the camshaft (3), and the blocking vane (37) cooperating with the camshaft (3) to form a blocking-vane pump which pumps fuel to the at least one pump element (15).

2. The high-pressure fuel pump of claim 1, further comprising an inside chamber (31) recessed out of the pump housing (1)

the camshaft (3) rotating in the inside chamber (31); and the blocking vane (37) and the camshaft (3) dividing the inside chamber (31) into a suction chamber (41) and a pressure chamber (43).

3. The high-pressure fuel pump of claim 2, further comprising a first hydraulic connection (45) exists between the pressure chamber (43) and the pump element (15).

4. The high-pressure fuel pump of claim 3, further comprising a groove (47) provided on the side of the blocking vane toward the pressure chamber (43), the groove (47) being part of the first hydraulic connection (45).

5. The high-pressure fuel pump of claim 2, wherein the pressure chamber (43) is located opposite the pump element (15).

6. The high-pressure fuel pump of claim 2, further comprising a roller tappet (13) disposed between the pump element (15) and the camshaft (3).

7. The high-pressure fuel pump of claim 6, wherein the roller tappet (13) is guided in the pump housing (1); and wherein a second hydraulic connection (53) is provided, between the side of the roller tappet (13) remote from the inside chamber (31) and the suction chamber (41).

8. The high-pressure fuel pump of claim 6, wherein the roller tappet (13) is guided in the pump housing (1); and wherein the side of the roller tappet (13) remote from the inside chamber (31) is acted upon by some of the fuel pumped by the blocking-vane pump.

9. The high-pressure fuel pump of claim 7, wherein the roller tappet (13) is guided in the pump housing (1); and wherein the side of the roller tappet (13) remote from the inside chamber (31) is acted upon by some of the fuel pumped by the blocking-vane pump.

10. The high-pressure fuel pump of claim 8, further comprising a throttle (65) in the second hydraulic connection (53).

11. The high-pressure fuel pump of claim 8, further comprising a pressure regulating valve (63) for regulating the pressure on the side of the roller tappet (13) remote from the inside chamber (31) is provided.

12. The high-pressure fuel pump of claim 10, further comprising a pressure regulating valve (63) for regulating the pressure on the side of the roller tappet (13) remote from the inside chamber (31) is provided.

13. The high-pressure fuel pump of claim 1, further comprising an intake throttle regulator regulating the pumping quantity of the at least one pump element (15).

14. The high-pressure fuel pump of claim 1, wherein regulation of the pumping quantity of the pump element (15) is effected by diverting the excess pumping quantity during the pumping stroke of the at least one pump element (15).

15. The high-pressure fuel pump of claim 1, wherein the camshaft (3) comprises a plurality of cams (33) distributed over its circumference.

16. The high-pressure fuel pump of claim 1, wherein the camshaft (3) is embodied integrally with a shaft of the engine, in particular with a compensation shaft or a camshaft.

17. The high-pressure fuel pump of claim 1, wherein the pump is flanged to the engine.

18. The high-pressure fuel pump of claim 1, wherein the pump pumps into a high-pressure fuel reservoir.

19. The high-pressure fuel pump of claim 1, further comprising a fuel return for carrying away excess fuel.

* * * * *